United States Patent [19]

Gidseg et al.

[11] Patent Number: 4,864,691

[45] **Date of Patent: * Sep. 12, 1989**

[54] HINGE ASSEMBLY

[75] Inventors: Edward D. Gidseg, 16 Duke of Gloucester, Manhasset, N.Y. 11030; Jan Ganik, Fresh Meadows, N.Y.

[73] Assignee: Edward D. Gidseg, Glendale, N.Y.

[ * ] Notice: The portion of the term of this patent subsequent to Oct. 4, 2005 has been disclaimed.

[21] Appl. No.: 45,957

[22] Filed: May 1, 1987

[51] Int. Cl.[4] ..... E05D 11/10

[52] U.S. Cl. ..... 16/312; 16/317; 16/318; 16/341; 16/342; 16/344; 16/386; 312/138.1

[58] Field of Search ..... 16/231, 273, 312, 316, 16/317, 318, 341, 342, 347, 344, 386, DIG. 27; 312/138 R, 214, 116

[56] References Cited

U.S. PATENT DOCUMENTS

| | | | |
|---|---|---|---|
| 54,618 | 5/1866 | Slusser . | |
| 393,200 | 11/1888 | Abbott . | |
| 420,997 | 2/1890 | Hess . | |
| 542,051 | 7/1895 | Heller . | |
| 874,746 | 12/1907 | Dennis . | |
| 889,834 | 6/1908 | Waters . | |
| 1,062,623 | 5/1913 | Waters . | |
| 1,294,044 | 2/1919 | Buckwalter et al. . | |
| 1,612,462 | 2/1924 | Mumford . | |
| 3,205,532 | 9/1965 | MacDonald | 16/180 |
| 3,228,058 | 1/1966 | MacDonald | 16/184 |
| 3,262,149 | 7/1966 | Gorton et al. | 16/147 |
| 3,262,745 | 7/1966 | Golzer et al. | 16/260 |
| 3,335,454 | 8/1967 | Dunster | 16/189 |
| 3,381,332 | 5/1968 | Jerila et al. | 16/139 |
| 3,391,420 | 7/1968 | Anderson | 16/139 |
| 3,418,683 | 12/1968 | Stone et al. | 16/145 |
| 3,577,840 | 5/1971 | Buberniak | 16/142 |
| 3,628,845 | 12/1971 | Grimm | 16/312 |
| 3,722,031 | 3/1973 | Bourgeois | 16/317 |
| 4,090,274 | 5/1978 | Bourgeois | 16/317 |
| 4,170,391 | 10/1979 | Bottger | 312/214 |
| 4,340,991 | 7/1982 | Gidseg | 16/254 |
| 4,424,607 | 1/1984 | Langenhorst | 16/386 |
| 4,774,740 | 10/1988 | Gidseg | 16/344 |

FOREIGN PATENT DOCUMENTS

| | | | |
|---|---|---|---|
| 207681 | 1/1908 | Fed. Rep. of Germany . | |
| 476789 | 1/1928 | Fed. Rep. of Germany . | |
| 642116 | 8/1928 | France . | |
| 2002358 | 10/1969 | France | 16/265 |
| 210146 | 12/1967 | Sweden | 16/265 |

*Primary Examiner*—Nicholas P. Godici
*Assistant Examiner*—Edward A. Brown
*Attorney, Agent, or Firm*—Pennie & Edmonds

[57] ABSTRACT

A hinge for rotatably mounting a barrier member to a structural member. The hinge comprises a first hinge assembly which comprises a first hinge bracket attachable to the structural member, a second hinge bracket attachable to the barrier member, a first hinge member mounted for rotation with the second hinge mounting bracket and a second hinge member mounted for rotation with the first hinge member. Both hinge members have correspondingly configured engaging surfaces which permit staged rotation between the hinge members. This facilitates a staged rotation of the barrier member in predetermined sequential increments as determined by the engaging surfaces. This first hinge assembly connects a lower portion of the barrier member to the structural member and is responsible for bearing substantially all of the weight of the barrier member. The invention further comprises at least a second hinge assembly for providing rotational alignment between an upper portion of the barrier member and the structural member.

16 Claims, 6 Drawing Sheets

FIG. 4
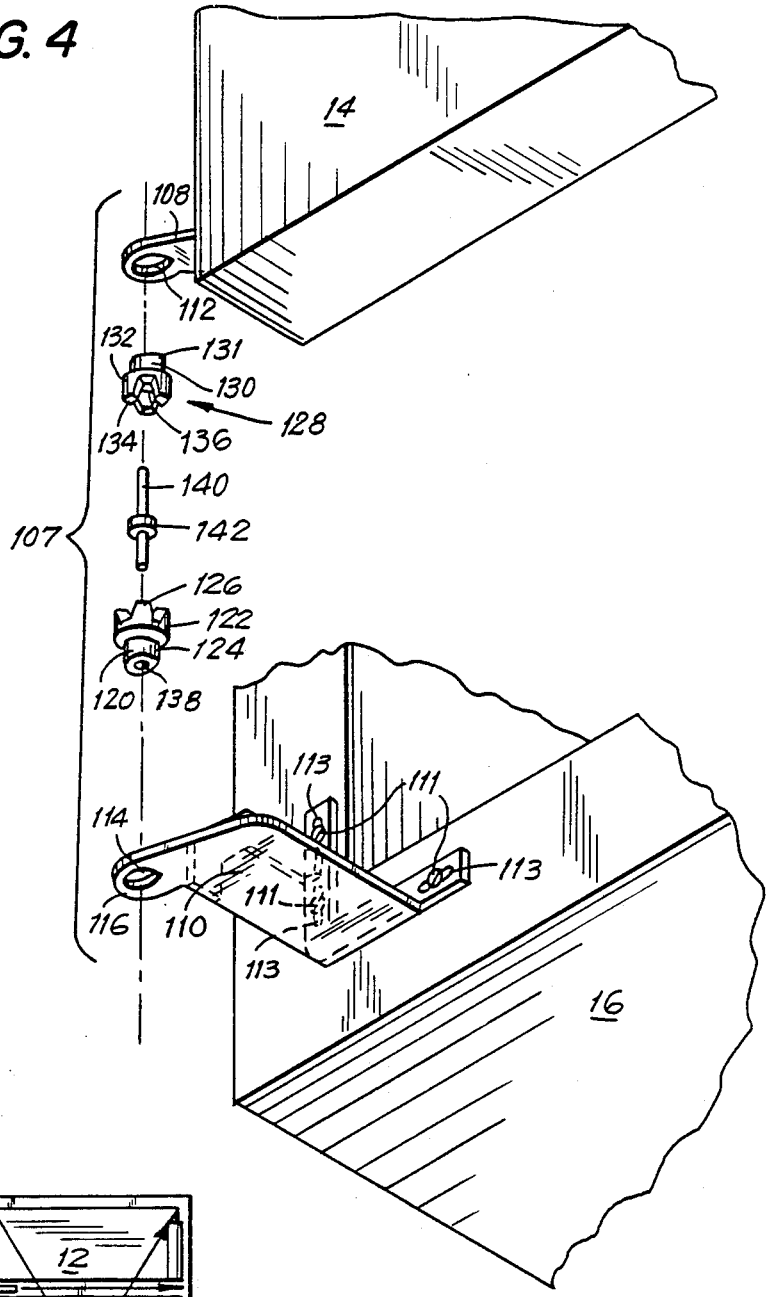
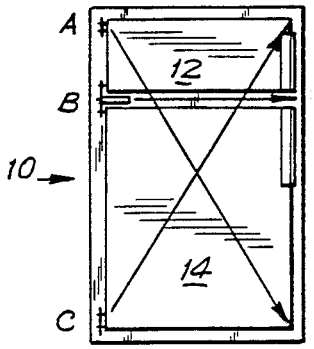
FIG. 5

12
192
204
210
200
202
16
206
214
214
198
196
191
212
194
208
14

HINGE ASSEMBLY

TECHNICAL FIELD

The invention relates to a hinge used to mount a door to a structural member. In particular, the invention relates to space-saving hinge assemblies for use with an upper and a lower door of a refrigeration cabinet. These assemblies provide self-closing of the doors within a certain range of opening, free movement over other degrees of opening and outward urging over still other degrees of opening.

BACKGROUND ART

A wide variety of hinges are currently available and well known to those skilled in the art. A number of these hinges are described as "self latching" hinges in that they provide a spring-loaded apparatus for urging a door to a closed position as the door is moved through one portion of its range of motion and further wherein the hinge is disabled from acting on the door when the door is moved to other positions. These hinges also include various types of self latching devices to maintain the door in a closed position. Some hinges are also provided with a so-called overcenter position to bias the hinge, thus providing a stronger hold on the door in a closed position.

The hinges described above are of relatively complicated construction, or require complex spring assemblies for proper operation. Other disadvantages include the use of different parts for left hand opening and right opening doors, the criticality of proper alignment for installing the hinge, the relatively large size of the hinge, and the provision of a relatively large space for clearance between the hinge and the door.

In our copending patent application entitled DOOR HINGE, Ser. No. 855,050, filed on Apr. 23, 1986, we disclose a novel hinge for rotatably mounting a barrier member. This hinge has first hinge mounting means adapted for attachment to the structural means and second hinge mounting means adapted for attachment to the barrier member and further defines an aperture for demountable engagement of a hinge member. A first hinge member is demountably positioned within the aperture defined by the second hinge mounting means for rotation therewith and a second hinge member, freely movable with respect to the first and the second hinge mounting means, is positioned at a predetermined offset angle relative to the first hinge member. The hinge further includes means for preventing rotation of the second hinge member with respect to the first mounting means.

Both the first and second hinge members of our earlier hinge have correspondingly configured engaging surfaces which, in conjunction with the offset positioning of these hinge members, facilitates the staged rotation of the barrier member in predetermined increments. The arc traversed during the rotation of the barrier member is determined by the respective engaging surfaces of the hinge members.

Our earlier hinge, as described above, overcomes the aforementioned difficulties in providing stepped door movements and biased closed and opened door positions. It is comprised of a minimal amount of easily manufactured components which are relatively simple to align and which require no complex spring assembly. The same assembly may be used for left hand opening and right hand opening doors and the size of the hinge assembly need not be increased in order to perform the claimed functions.

We have now invented an improved hinge assembly which retains the functional attributes of our earlier hinge while reducing the amount of space and material required for its installation. Use of the novel hinge assemblies disclosed herein thus facilitates the construction of refrigeration cabinets and refrigerator-freezer combinations having larger, more easily mountable doors on cabinets which are limited in height and/or width due to constraints imposed by the space often available for such appliances. This hinge arrangement also permits these doors to be installed closer together for a more pleasing aesthetic appearance.

SUMMARY OF THE INVENTION

The present invention comprises a hinge for rotatably mounting a barrier member to structural means. One embodiment of the invention comprises a first hinge assembly. This first hinge assembly comprises first hinge mounting means having means for attachment thereof to the structural means; second hinge mounting means, which has means for attachment thereof to the barrier member; a first hinge member mounted for rotation with the second hinge mounting means and a second hinge member mounted for rotation with the first hinge member.

The first and second hinge members each have engaging surfaces correspondingly configured to permit staged rotation between the first and second hinge members, thereby facilitating a staged rotation of the barrier member in predetermined sequential increments as determined by the respective engaging surfaces. The first hinge assembly connects a lower portion of the barrier member to the structural means and bears substantially all the weight of the barrier member. Further, a second hinge assembly provides rotational alignment between an upper portion of the barrier member and the structural means.

The surfaces of the hinge are further provided with corresponding engagement means to retain the first hinge member and the second mounting means in a predetermined position. This maintains the barrier member in at least one of at least three positions with respect to the structural means, which positions correspond to one opened position, one intermediate position and one closed position. These engagement means comprise a plurality of substantially identical crenulations, each having oppositely sloped sides.

The barrier member to which the hinge may be mounted is preferably door means. The structural means to which the barrier member is attached preferably comprises a frame member for a refrigerated cabinet. Further, the hinge mounting means are bracket means removably attached by bolts, screws or adhesive means.

In one embodiment of the hinge described above, the second hinge assembly comprises a third hinge mounting means having means for attachment thereof to the structural means and fourth hinge mounting means having means for attachment to an upper portion of the barrier member. Furthermore, this second hinge assembly comprises a third hinge member mounted for rotation with the fourth hinge mounting means, as well as a fourth hinge member mounted for rotation with the third hinge member. The first and second hinge members each have relatively smooth engaging surfaces to facilitate rotation therebetween.

The first and second hinge members are similarly and correspondingly configured to facilitate mounting the barrier member to the structural means for left hand or right hand rotation. Further, the first, second, third and fourth hinge members may be constructed of, for example, Delrin ®, nylon or metal.

An alternate embodiment of the hinge for rotatably mounting a door to frame means of a refrigerator-freezer combination comprises a first hinge assembly comprising first hinge mounting means configured for removable attachment thereof to a structural member of the frame means wherein the first hinge mounting means defines at least one aperture. The embodiment further comprises second hinge mounting means configured for removable attachment thereof to a lower portion of the door. The second mounting means also defines at least one aperture. A first hinge member is mounted in a predetermined position in one of the apertures defined by the second mounting means for rotation with the second mounting means.

Further, the first hinge member comprises a base portion extending upwardly in a substantially vertical direction, configured for a corresponding interlocking fit within the aperture and a crown portion extending in a substantially vertical downward direction. This crown portion comprises a plurality of crenulations, each having two oppositely sloped sides. A second hinge member is mounted in a predetermined position in one of the apertures defined by the first mounting means for rotation with the second mounting means. The second hinge member is positioned at a predetermined orientation with respect to the first hinge member and comprises a base portion extending in a substantially vertical downward direction and a crown portion extending in a substantially vertical upward direction. The crown portion further comprises a plurality of crenulations, each having two oppositely sloped sides.

The crenulations of the first and second hinge members have substantially identical dimensions. The orientation of the second hinge member is offset at a predetermined angle with respect to the position of the first hinge member. Means for alignment of the first and the second hinge members is inserted therethrough in a substantially vertical position. The first hinge assembly connects a lower portion of the barrier member to the structural means and bears substantially all the weight of said barrier member. A second hinge assembly provides rotational alignment between an upper portion of the barrier member and the structural means.

Each hinge member may include, for example, three crenulations corresponding to three positions obtainable by the barrier member. The crenulations are rotationally separated from each other by approximately 120 degrees. The first and second hinge members are similarly and correspondingly configured to facilitate mounting the barrier member to the structural means for left hand or right hand rotation by either rotating the barrier position or by reversing the hinges.

A further embodiment of the invention comprises a hinge for rotatably mounting upper and lower barrier members to structural means. The hinge comprises a first hinge assembly having first hinge mounting means with means for attachment thereof to the structural means. A second hinge mounting means has means for attachment thereof to a lower portion of the upper barrier member. A first hinge member is mounted for rotation with the second hinge mounting means. A second hinge member is mounted for rotation with the first hinge mounting means.

The first and second hinge members each have engaging surfaces correspondingly configured to permit staged rotation between the first and second hinge members, thereby facilitating a staged rotation of the upper barrier member in predetermined sequential increments as determined by the respective engaging surfaces. This first hinge assembly further comprises means for aligning the first and second hinge members and this means extends through the first and second hinge mounting means and terminates at a point below the second hinge mounting means. The first hinge assembly bears substantially all the weight of the upper barrier member. A second hinge assembly for providing rotational alignment is located between an upper portion of the upper barrier member and the structural means.

A third hinge assembly of this embodiment provides rotational alignment between an upper portion of the lower barrier member and the structural means. It comprises a third hinge mounting means having means for attachment to an upper portion of the lower barrier member. A third hinge member is mounted upon the third hinge mounting means. The third member further defines a hollow bore which at least partially encompasses a lower portion of the alignment means for rotation with a lower portion of the first hinge mounting means. A fourth hinge assembly provides rotational alignment between a lower portion of the lower barrier member and the structural means whereby the upper and lower barrier members can be vertically spaced apart at a predetermined minimum distance.

The fourth hinge assembly comprises fourth hinge mounting means having means for attachment thereof to the structural means. A fifth hinge mounting means has means for attachment thereof to a lower portion of the lower barrier member. A fourth hinge member mounted for rotation with the fifth hinge mounting means and a fifth hinge member is mounted for rotation with the fourth hinge member. The fourth and fifth hinge members each have engaging surfaces correspondingly configured to permit staged rotation between the fourth and fifth hinge members, thereby facilitating a staged rotation of the lower barrier member in predetermined sequential increments as determined by the respective engaging surfaces. The fourth hinge assembly bears substantially all the weight of the barrier member.

Each of the first, second, fourth and fifth hinge members may include, for example, three crenulations corresponding to their positions of the barrier member. The crenulations are rotationally separated from each other by approximately 120 degrees.

The second hinge assembly comprises sixth hinge mounting means having means for attachment thereof to the structural means; seventh hinge mounting means having means for attachment to the upper portion of the upper barrier member; a sixth hinge member mounted for rotation with the seventh hinge mounting means and a seventh hinge member mounted for rotation with said sixth hinge member. The sixth and seventh hinge members each have relatively smooth engaging surfaces to facilitate rotation therebetween.

In a further embodiment of the invention, the third hinge member includes a smooth upper surface for engaging a lower surface of the first hinge mounting means and/or a lower surface of the second hinge member to facilitate rotation therebetween.

BRIEF DESCRIPTION OF THE DRAWINGS

Further benefits and advantages of the present invention will become apparent from a consideration of the following description given with reference to the accompanying drawing figures which specify and show preferred embodiments of the invention, and wherein:

FIG. 4 is an exploded view of the fourth hinge assembly according to the invention, illustrating its various components;

FIG. 5 is a perspective view of the refrigeration cabinet of FIG. 1, illustrating the interchangeability of the hinge assemblies of the invention utilized therewith for use with both left-hand and right-hand opening doors;

DETAILED DESCRIPTION OF THE PREFERRED EMBODIMENTS

The hinge of our invention as disclosed herein may be used in applications involving cabinets having both one door and two or more doors, mounted one above the other or side by side. The preferred embodiment of our invention entails the mounting and operation of upper and lower doors upon a refrigeration cabinet or a refrigerator-freezer combination. The hinge assemblies described herein require a minimal amount of easily manufactured components and thus permit the upper and lower doors to be installed in close proximity to one another in an aesthetically pleasing manner, rather than spaced widely apart as was previously required for providing clearance to accommodate the bulky hinge assemblies of the prior art. Such an arrangement provides a pleasing aesthetic appearance in that the bulky hinge assemblies previously utilized for such applications have been slimmed down in appearance and are at least partially or substantially hidden from view behind the cabinet doors in the present invention.

Figure 1:
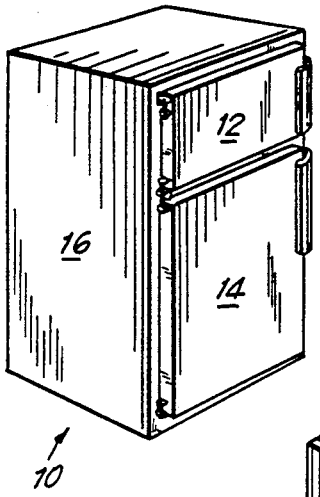
FIG. 1 is a perspective view of a refrigeration cabinet utilizing the hinge assemblies of the invention.

Referring initially to FIG. 1 there is illustrated a perspective view of refrigeration cabinet 10 utilizing the second hinge assembly disclosed herein to mount an upper portion of upper door 12 to frame 16 of cabinet 10. For reasons of efficient space utilization, the lower portion of door 12 is mounted by means of the first hinge assembly of the invention while the upper portion of door 14 is mounted with the third hinge assembly disclosed herein. This arrangement may be utilized whether the refrigeration cabinet utilizes a left-hand or right-hand opening door. An additional, independent, weight bearing hinge assembly, i.e., the fourth hinge assembly of the invention, comprises a mounting connection between the lower portion of door 14 and cabinet 16.

Figure 2:
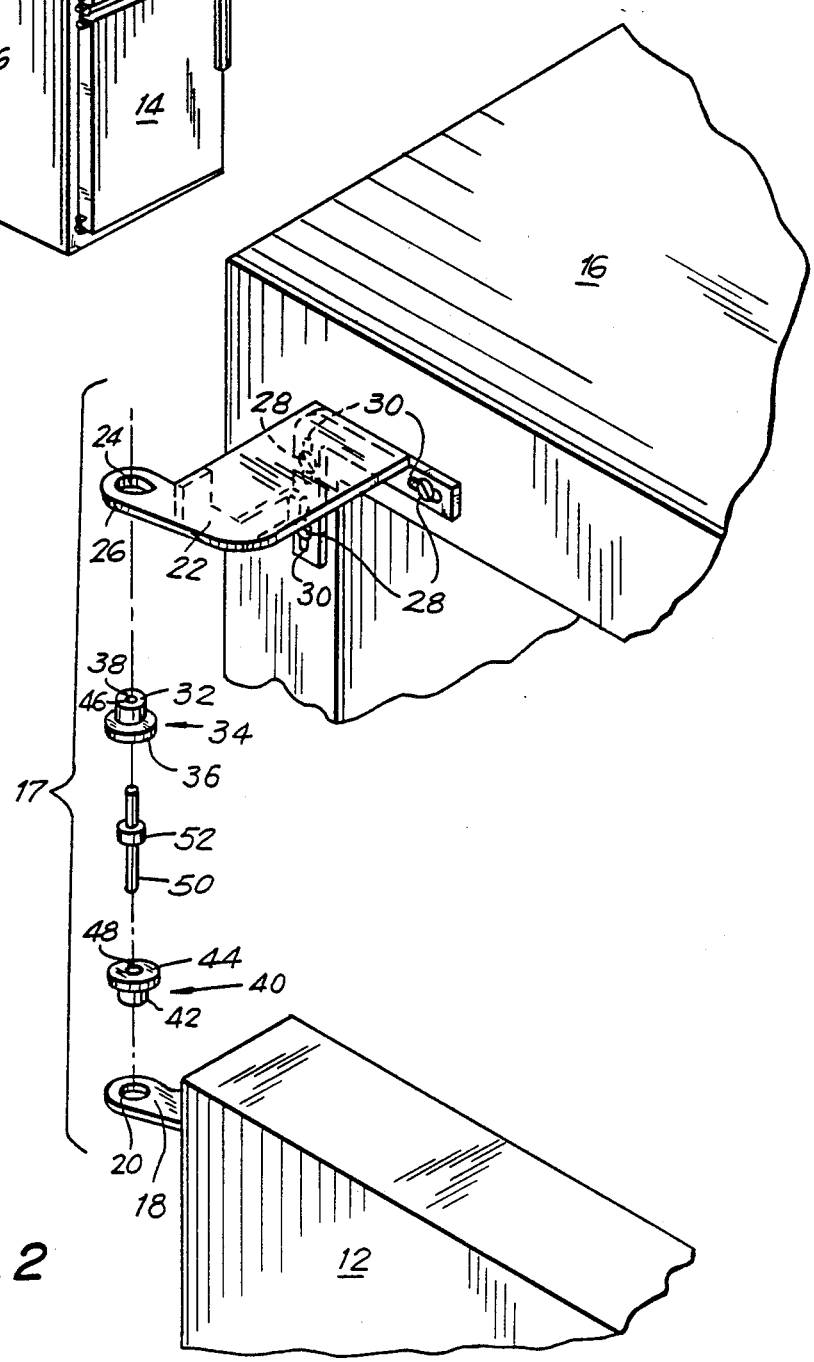
FIG. 2 is an exploded view of the second hinge assembly according to the invention, illustrating its various components.

FIG. 2 is an exploded view of the second hinge assembly, which is a simplified, non-weight bearing hinge assembly 17 used for hanging the upper portion of door 12 from frame 16 of cabinet 10. Mounting means, such as bracket 18 defining aperture 20, is preferably inserted into a slot or aperture (not shown) in a side portion of upper door 12 wherein it is engaged and thus maintained within a channel formed by the extrusions which comprise the frame of door 12. A preferred door construction is described in application Ser. No. 045,647, filed May 1, 1987, entitled REFRIGERATOR DOOR AND METHOD OF MAKING SAME. To the extent necessary for understanding the present invention, the disclosure of that application is expressly incorporated herein by reference.

Bracket 22, defining aperture 24 in flange 26, is preferably secured by screws 28 which pass through mounting slots 30 into frame 16. Bracket 22 may also be secured by bolts, by welding, by adhesives, etc. Further, the location of bracket 22 may be adjusted along the horizontal and/or vertical axis of frame 16 by loosening screws 28 and repositioning bracket 22 with the use of mounting slots 30.

Aperture 24 in bracket 22 is configured to orient in a predetermined position a base portion 32 of upper hinge member 34. This orientation is effected by means of lip 38 on base portion 32 of upper hinge member 34 which is immovably engaged by "pie-shaped" aperture 24 in flange 26. This arrangement prevents upper hinge member 34 from rotating with respect to mounting bracket 22. Crown portion 36 of upper hinge member 34, located below base 32, is integrally associated with base portion 32 and is configured as a flat disc having a smooth upper surface.

Lower hinge member 40 is configured in the same manner as upper hinge member 34 in that member 40 comprises base portion 42 constructed integrally with crown portion 44. Base portion 42 is circular in shape and is configured to extend through aperture 20 defined by hinge mounting means 18. Crown portion 44 is also configured as a flat disc having a smooth upper surface and is oriented so as to contact crown portion 36 of upper hinge member 34.

Both upper hinge member 34 and lower hinge member 40 further define a central bore 46, 48, respectively, extending vertically therethrough, adapted for the passage of alignment means such as pin 50, equipped with collar member 52, to prevent pin 50 from sliding out of the hinge assembly through bore 48 when door 12 is installed and/or operated in a vertical position. Disc-shaped crown portion 36 of upper hinge member 34 and the corresponding upper, i.e., crown portion 44, of lower hinge member 42 are preferably installed in contact with one another around alignment means 50 which extends therethrough to facilitate the smooth rotation of door 12. Alternately, a narrow gap may be maintained between the crown portions of the hinge members 34, 40, respectively, during rotation. In such an arrangement, collar member 52 of pin 50 may serve to maintain this spacing between the hinge members.

As noted above, the bulk of brackets 18, 22 has been reduced since this (second) hinge assembly is not a weight bearing hinge. Further, bracket 18 is preferably installed within door 12 by slideably engaging a base portion of bracket 18 in channel means (not shown) formed by the extrusions which comprise the outer frame of door 12. This method has been adopted to reduce the working tolerances required between the frame of the cabinet and the doors as well as between the doors themselves. The choice of this location for bracket 18 thus permits bracket 22 to be installed on the front face of cabinet 16 instead of on top thereof as was previously done in the prior art. As a result, this hinge assembly may be partially covered by the surface of upper door 12. This gives a more aesthetically pleasing appearance to the refrigeration cabinet.

Figure 3:
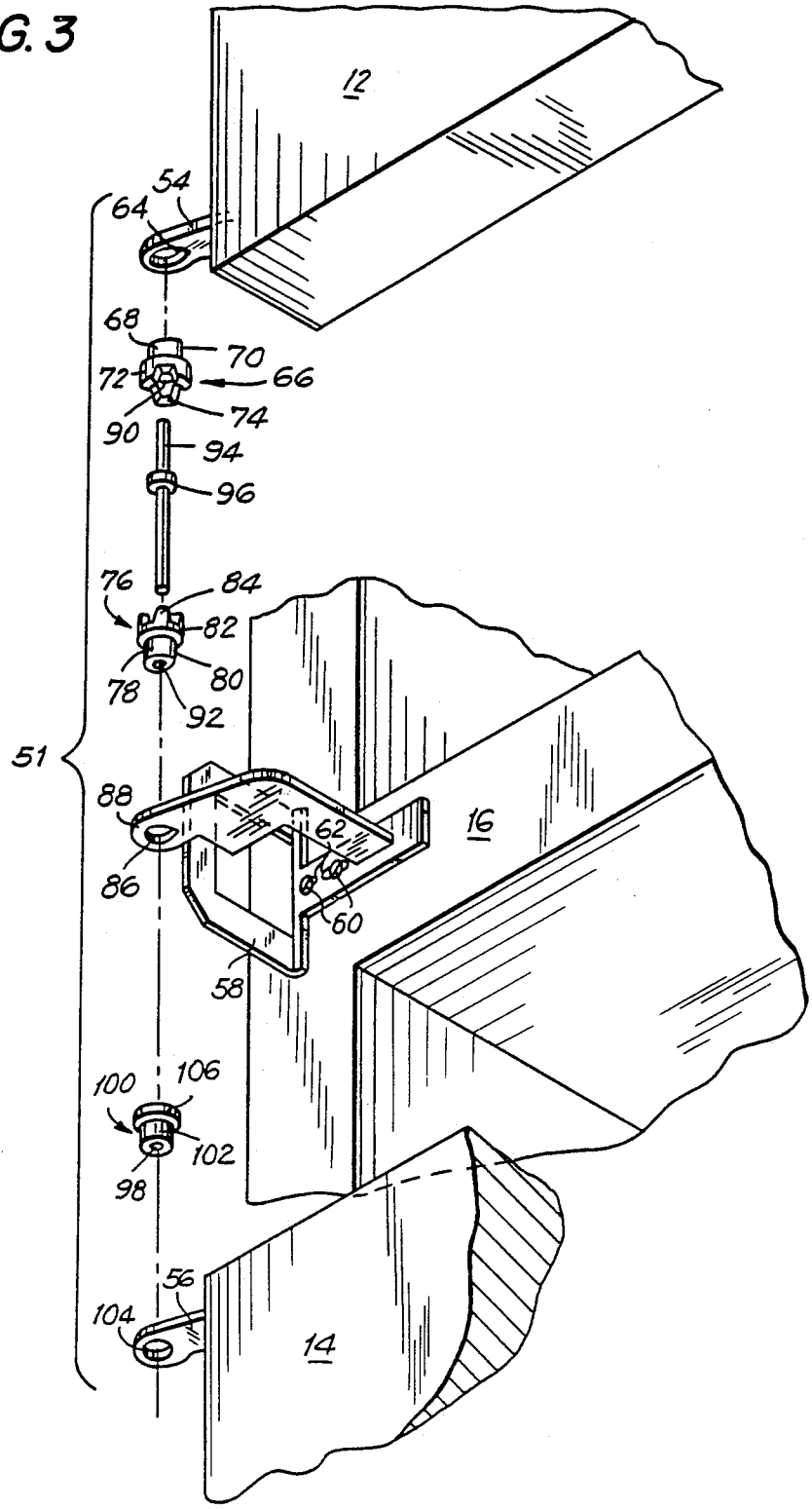
FIG. 3 is an exploded view of the combination of the first and the third hinge assemblies according to the invention, illustrating their various components.

Turning now to FIG. 3, there is illustrated the interactive construction of the first and third hinge assembly 51 for use in mounting both the lower portion of upper door 12 and the upper portion of lower door 14 to cabinet 16. These combined assemblies comprise, in part, an upper hinge mounting means, such as bracket 54 and a lower hinge mounting means, such as bracket 56, attached to upper door 12 and lower door 14 respectively. Also included as part of these assemblies is a hinge support means, such as bracket 58 which is mounted on frame 16 of cabinet 10.

The first hinge assembly, i.e., that portion between support means 58 and bracket 54, serves as a weight bearing hinge to support the weight of door 12. Conversely, the second hinge assembly, i.e., between support means 58 and bracket 56, does not support the weight of door 14, but rather serves only as a hanger member to mount door 14 to frame 16 and to facilitate its rotation. The weight of door 14 must therefore be borne by a fourth hinge assembly at the lower edge of the door, which is discussed below.

Upper and lower mounting brackets 54, 56 may be mounted within doors 12, 14 respectively in the same manner as bracket 18 illustrated in FIG. 2., i.e., by slidingly inserting them within channel means (not shown) forming a portion of the frame for doors 12 and 14. Conversely, bracket 58, mounted on frame 16 between upper door 12 and lower door 14, is preferably attached to the frame by bolts or screws 60, by welding or with the use of an adhesive. Screws 60 pass through elongated mounting slots 62 so as to permit bracket 58 a limited degree of horizontal movement to facilitate the alignment of the respective hinges.

Aperture 64, defined by upper hinge mounting means 54, is configured to accept a base portion 68 of an upper hinge member 66. Upper hinge member 66 is configured differently from the upper hinge member 34 of FIG. 2. Hinge member 66 comprises base portion 68 having lip 70 to prevent rotation upon engagement with aperture 64 of upper hinge mounting bracket 54. Hinge member 66 further comprises crown portion 72 integrally associated therewith. Crown portion 72 is provided with a plurality of crenulations 74 on its lower surface. Each of these crenulations is provided with two oppositely sloped sides.

Lower hinge member 76 is configured in a manner similar to that of upper hinge member 66 in that hinge member 76 comprises base portion 78 having lip portion 80 constructed integrally with crown portion 82. Crown portion 82 also contains a plurality of crenulations 84 on its upper surface, each of which is provided with two oppositely sloped sides. The effect of lip portion 80, therefore, is to prevent the rotation of lower hinge member 76 within aperture 86 located in flange 88 of hinge mounting support means 58.

Both upper hinge member 66 and lower hinge member 76 define a hollow bore 90, 92 respectively, extending therethrough, into which may be inserted an alignment means, preferably pin 94, which is provided with collar 96. Lower hinge member 76 is positioned below upper hinge member 66 and aligned so that the crenulations 84 of lower hinge member 76 extend in a substantially vertical upward direction to intersect in offset alignment with the crenulations 74 of upper hinge member 66, which are oriented in a substantially downward direction.

By "offset alignment" we mean that with upper door 12 in a tightly closed position, the sloped sides of crenulations 74 on upper hinge member 66 are not perfectly aligned with the gaps between the crenulations 84 on lower hinge member 76. There is a slight gap between the surfaces (illustrated in FIG. 8 discussed below) due to a predetermined angle of offset which exists between the upper 66 and lower 76 hinge members. This is caused by the positioning of their base portions i.e., 68 and 78 respectively, in apertures 64 and 86, which thus orients the integral crown portion of each of the hinge members.

The resultant tendency of the crenulations located upon the upper and lower hinge members, i.e., 66 and 76, is to seek locking engagement with each other due &:o the weight of the door. This weight provides a force urging the door into closer contact with the structural member 16 forming the frame of the refrigeration cabinet 10, thus conserving the cold air within cabinet 10.

Pin 94 serves to align the upper 66 and lower 76 hinge members by passing an upper portion of pin 94 through a hollow bore 90 defined by upper hinge member 66 and a lower portion of the pin through and out of a corresponding bore 92 in lower hinge member 76. Collar member 96 maintains pin 94 in position and prevents it from sliding or!t of position through bore 92.

It must be noted, however, that pin 94 is not evenly dimensioned both above and below collar member 96. Rather, the pin extends a greater distance below collar member 96 than above to provide sufficient length to extend completely through bore 92 and at least partially into bore 98 located through hinge member 100, which is utilized to mount the upper portion of door 14 to frame 16 of cabinet 10. Hinge member 100 is comprised of base portion 102 which is configured for insertion into aperture 104 defined by lower hinge mounting means 56 and integral crown portion 106 which may be installed in contact with a lower portion of the base 78 of lower hinge member 76.

To facilitate such an installation, crown 106 is a smooth, flat, disc configured for smooth rotation with that portion of base 80 extending below hinge support 58 or, optionally, with a lower surface of hinge support 58. This arrangement is permissible because hinge member 100 bears little, if any, weight of door 14. Rather, the fourth hinge assembly, located at a bottom edge of the door, as discussed below, performs this function.

FIG. 4 illustrates the weight bearing fourth hinge assembly 107 which may be useful for mounting a lower portion of door 14 to cabinet 16. This hinge is clearly comparable to the first hinge assembly as depicted in FIG. 3, which performs the same function for door 12. The fourth hinge assembly comprises a door mounted bracket 108 and a cabinet mounted bracket 110. Door mounted bracket 108 is slidingly engaged within a channel located within the members forming the frame of door 14 as described above. Bracket 110 may be adjustably mounted with bolts or screws 111 which are inserted through elongated mounting slots 113, permitting horizontal and/or vertical movement of bracket 110 for alignment purposes.

Each bracket 108, 110 defines an aperture 112, 114 respectively, for mounting a hinge member. Aperture 114 is located in flange 116 of bracket 110 and is configured to accept base portion 120 of hinge member 118. Base portion 120 is provided with lip 124 to prevent rotation thereof within aperture 114. Furthermore, base portion 120 is integrally constructed with crown portion 122 which is provided with a plurality of crenulations 126 on its upper surface, each having two oppositely sloped sides.

Hinge member 128 is configured in a manner similar to that of hinge member 118 in that it comprises base portion 130 having lip 131 to prevent the rotation thereof, constructed integrally with crown portion 132. Crown portion 132 also contains a plurality of crenulations 134 on its lower surface, each having oppositely sloped sides.

Lower hinge member 118 is positioned below upper hinge member 128 and aligned so that the crenulations 126 of lower hinge member 118 extend in a substantially vertical upward direction to intersect in offset alignment with the crenulations 134 of upper hinge member 128 which extend downwardly.

Alignment means such as pin 140 serves to align hinge members 118, 128 in the proper position by passing through hollow bores 136, 138 defined by upper and lower hinge members 128, 118 respectively. Collar member 142 serves to prevent pin 140 from sliding completely through bore 138 in hinge member 118 when lower door 14 is installed and/or operated in a vertical position. In the embodiment depicted in FIG. 4, pin member 142 is preferably constructed of equal length both above and below collar member 142.

FIG. 5 discloses that the hinge assemblies of the present invention may be utilized for both left hand and right hand opening cabinet doors. In order to convert, for example, a right hand opening refrigerator door to one opening in the opposite direction, one must reinstall the hinge assemblies illustrated in FIGS. 2, 3 and 4, as directed by the arrows in FIG. 5.

Figure 6:
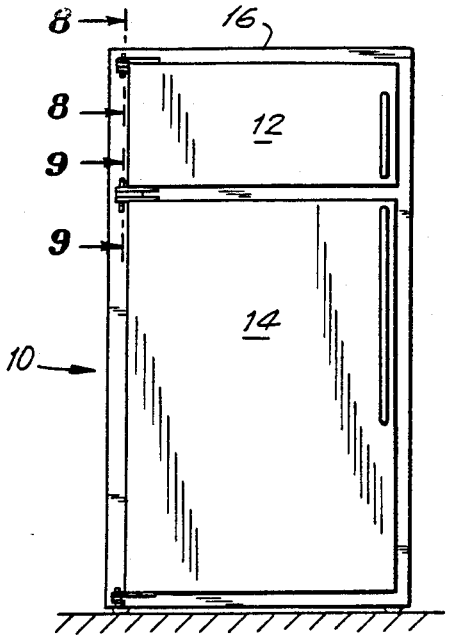
FIG. 6 is a perspective view of a refrigeration cabinet utilizing alternate embodiments of the hinge assemblies illustrated in FIGS. 2-4.

FIG. 6 is a frontal view of a refrigerator-freezer combination utilizing alternate embodiments of the hinge assemblies depicted in FIGS. 2–4.

Figure 7:
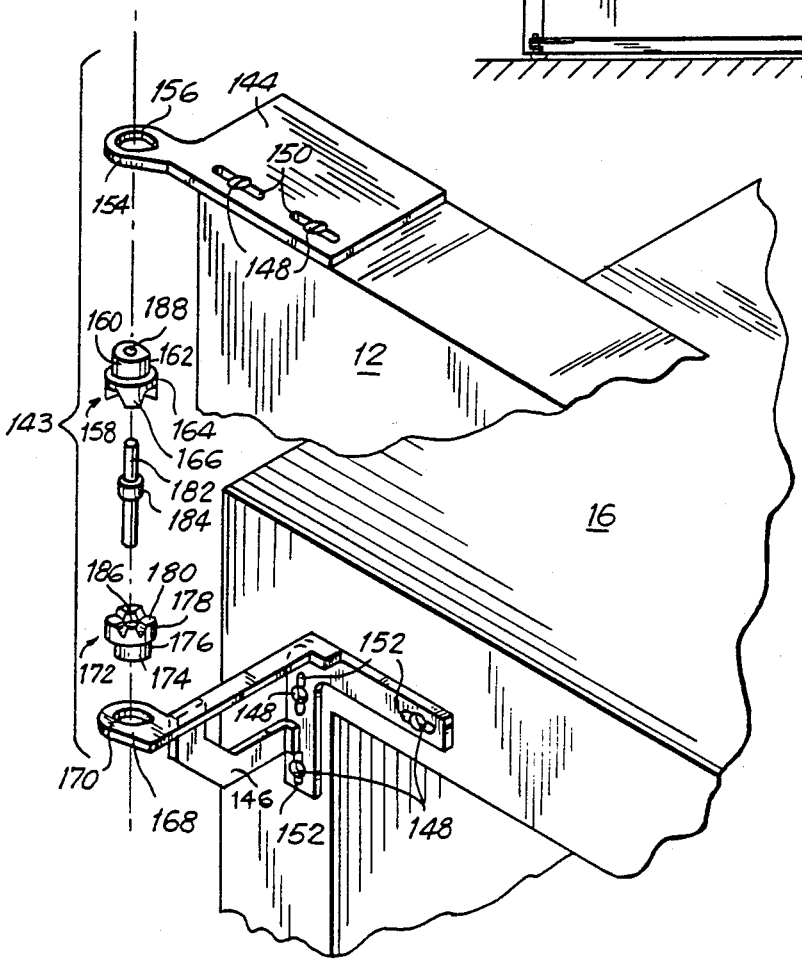
FIG. 7 is an exploded view of an alternate embodiment of the second hinge assembly of the invention, illustrating its various components.

FIG. 7 is an exploded view of an alternate embodiment of second hinge assembly 143 of this embodiment. This assembly utilizes hinge mounting means 144 located on an upper surface of upper door 12 and hinge mounting means 146 located on frame 16. Mounting means such as brackets 144, 146 are preferably installed on door 12 and frame 16 respectively with screws 148 which are inserted through elongated mounting slots 150, 152 respectively and thereafter into the underlying structure. Mounting brackets 144, 146 may thus be moved so as to align the hinge member by loosening the mounting screws and moving the bracket in the direction permitted by mounting slots 150, 152. Alternately, hinge mounting means 144, 146 may be attached by bolts, adhesives, by welding, etc.

Hinge mounting means 144 is provided with flange 154 defining aperture 156. The subject aperture is configured so as to prevent the rotation of a base portion 160 of upper hinge member 158. To further prevent the rotation of hinge member 158, base portion 160 thereof is provided with lip 162 which is configured to fit through pie-shaped aperture 156. Furthermore, base portion 160 is integrally constructed with crown portion 164 to form hinge member 158, and, together, they define hollow bore 188. Crown portion 164 is additionally provided with a plurality of crenulations, each having oppositely sloped sides.

In a similar manner, hinge mounting means 146 is constructed with flange 168 which defines pie-shaped aperture 170. This aperture is configured for the insertion of base portion 174 of lower hinge member 172. Base portion 174 is further provided with lip portion 176 configured to prevent rotation of hinge member 172 in aperture 170. Further, base portion 174 is integrally constructed with crown portion 178, which, in combination with base portion 174, defines bore 186. Crown portion 178 is provided with a plurality of crenulations 180. Each of these crenulations 180 has two oppositely sloped sides.

In order to maintain upper 158 and lower 172 hinge members in alignment, therefore, we utilize alignment means such as pin 182 provided with collar member 184. The portions of pin 182 above and below collar 184 are preferably of an equal length, in contrast to pin 94. The purpose of collar 184 is to prevent pin 182 from sliding out of the second hinge assembly through bore 186 when door 12 is installed and/or operated in a vertical position. Further, by means of alignment pin 182, the crenulations 166, 180 of upper 158 and lower 172, hinge members respectively, are maintained in an offset alignment as defined above.

Figure 8:
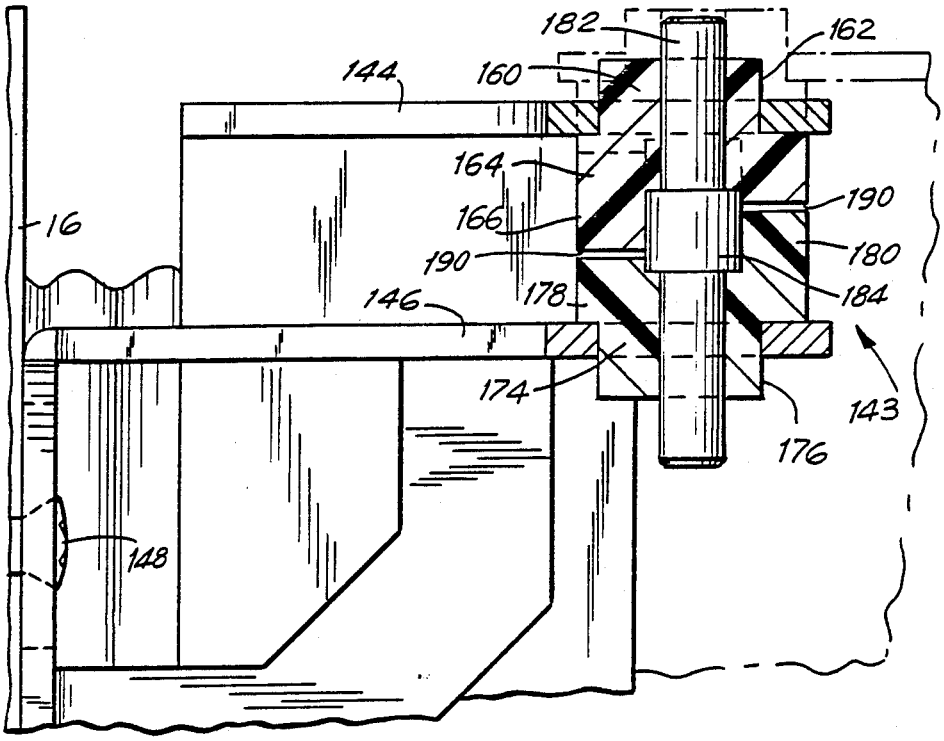
FIG. 8 is a cross sectional view of the second hinge assembly as depicted in FIG. 7, taken along lines 8—8 of FIG. 6.

Turning now to FIG. 8, there is illustrated a crosssectional view taken along lines 8—8 of FIG. 6 of the second hinge assembly, useful for mounting door 12, as depicted in FIG. 7. This figure clearly illustrates: gaps 190 which are created between the crenulations 166, 180 of the upper 158 and lower 172 hinge members, respectively. These gaps 190 are created by the "offset alignment" of the hinge members as described above and facilitate the creation of a positive force which urges door 12 more tightly closed against frame 16 of cabinet 10.

Figure 9:
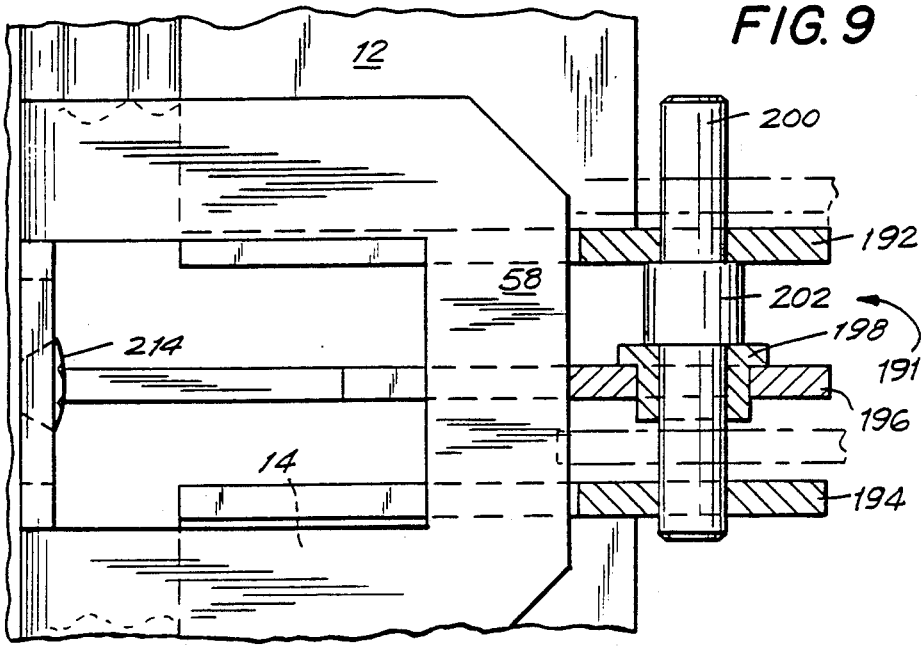
FIG. 9 is a cross sectional view of alternate embodiments of the combination of the first and third hinge assemblies as depicted in FIG. 10, taken along lines 9—9 of FIG. 6.
Figure 10:
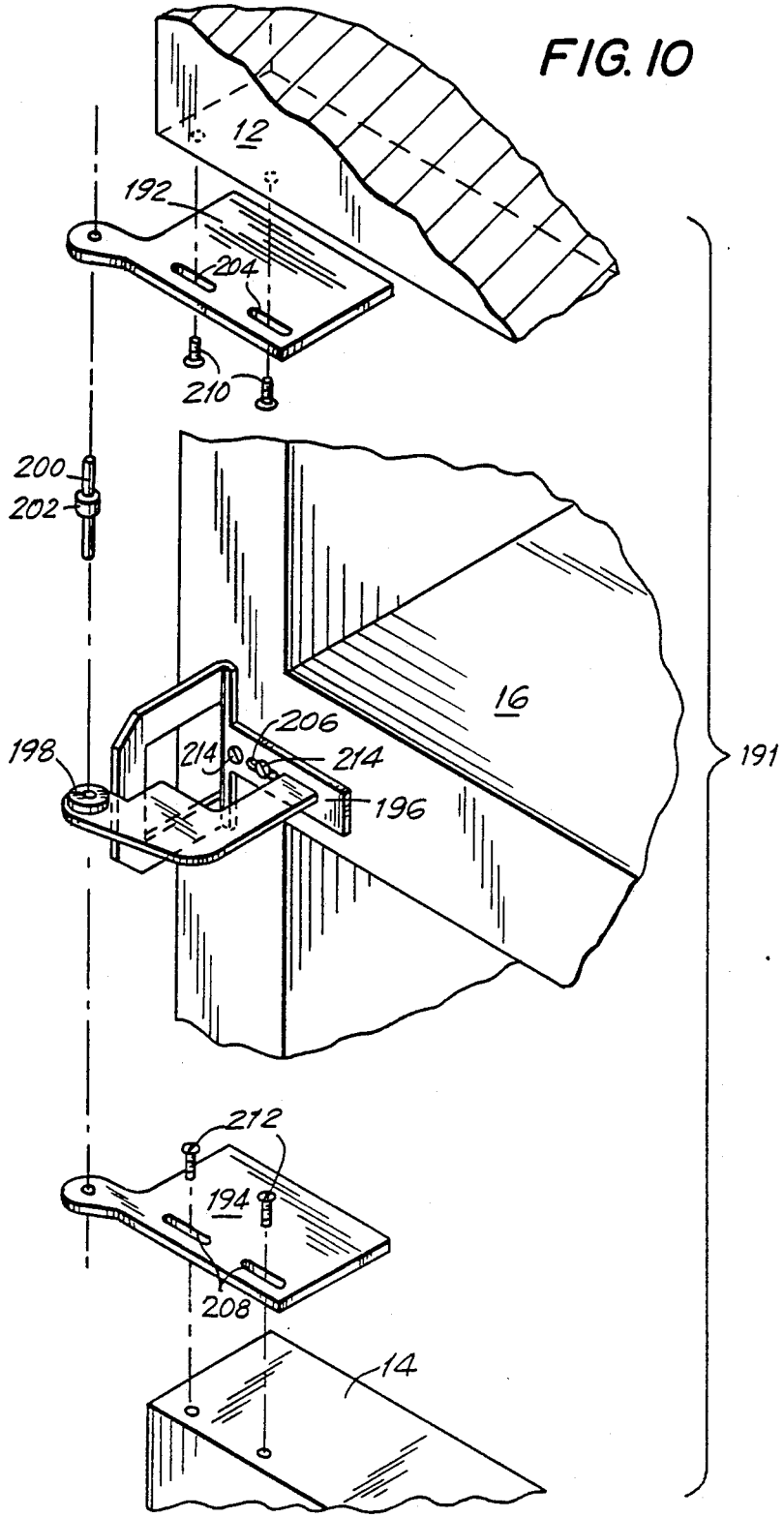
FIG. 10 is an exploded view of the combination of the first and the third hinge assemblies shown in cross section in FIG. 9, illustrating their various components.

FIG. 9 is a cross sectional view of an alternate embodiment of the first and third hinge assembly combination 191 for use between doors 12, 14 of cabinet 10, as shown in FIG. 10. This view is taken along lines 9—9 of FIG. 6. The embodiment comprises, in part, upper 192 and lower 194 hinge mounting means which are respectively installed on a lower surface of door 12 and an upper surface of door 14. These mounting means are preferably maintained in position by the use of bolts or screws (not shown) which are inserted through elongated mounting grooves defined by these brackets. Alternate methods for fastening these brackets include the use of adhesives, welding, etc.

Hinge assembly 191 further includes support bracket 196 which defines an aperture configured for the insertion of bushing 198 having a hollow central bore. Pin member 200 extends both upwardly and downwardly from bushing 198 through apertures defined in brackets 192, 194, respectively and further extends through collar member 202 in its upward course. This permits the rotation of the hinge assembly 191 around pin member 200 while preventing the pin from slipping out of position through bushing 198 and the aperture in bracket 194 when the doors are installed and/or utilized in a vertical position.

The horizontal phantom lines located directly above mounting brackets 192 and 194 represent the relative positions which these brackets assume when door 12 and/or 14 is rotated into an open position. At such a point, the interaction of the crenulations on the upper and lower hinge members forming a part of the hinge assembly mounted at the top of door 12 and the bottom of door 14 causes the door to ride upward into an intermediate position as illustrated by the phantom positions for the brackets attached thereto. FIG. 9 clearly illustrates that adequate clearance exists between &:he hinge brackets mounted on doors 12, 14 to permit completely unobstructed operation of the first and third hinge assemblies.

As discussed above, FIG. 10 is an exploded view of the combination of the first and third hinge assemblies 191 which were depicted in cross section in FIG. 9. In addition to the alignment capabilities of pin member 200, the alignment of the hinge assembly, as depicted in FIG. 9, may be further adjusted by the use of mounting slots 204, 206, 208 located in brackets 192, 198, 194 respectively. By backing mounting screws 210, 212 a short distance out of door 12 or 14 respectively and/or partially loosening screws 214 from frame 16, the subject brackets may be provided with a limited range of movement which facilitates the vertical alignment of hinge assembly 191.

While hinge members 34, 40, 66, 76, 118, 128, 164, 180 and 198 may ordinarially be constructed out of any suitable material, the most preferred material is an injection molded thermoplastic, with Delrin®.or nylon providing optimum performance. As one skilled in the art would realize, metals or other materials which require machining to conform to the particular shapes disclosed would be more useful although expensive. For particular applications requiring extremely high load bearing capabilities, metals or ceramics may be desirable as suitable hinge materials.

While it is apparent that the invention herein disclosed is well calculated to fulfill the objects above stated, it will be appreciated that numerous modification and embodiments may be devised by those skilled in the art, and it is intended that the appended claims cover all such modifications and embodiments as fall within the true spirit and scope of the present invention.

We claim:

1. A hinge for rotatably mounting a barrier member to structural means which comprises:

(a) a first hinge assembly comprising (1) first hinge mounting means having means for attachment thereof to the structural means;

(2) second hinge mounting means having means for attachment thereof to the barrier member;

(3) a first hinge member removably mounted within an aperture for rotation with said second hinge mounting means; and (4) a second hinge member mounted for rotation with said first hinge member;

said first and second hinge members each having engaging surfaces correspondingly configured to permit staged rotation between said first and second hinge members, thereby facilitating a staged rotation of said barrier member in predetermined sequential increments as determined by said respective engaging surfaces, said first hinge assembly connecting a lower portion of the barrier member to said structural means and bearing substantially all the weight of said barrier member;

wherein said surfaces have corresponding engagement means to retain said first hinge member and said second mounting means in a predetermined position which thereby maintains the barrier member in at least one of at least three positions with respect to said structural means, which positions correspond to one opened position, one intermediate position and one closed position; and (b) a second hinge assembly for providing rotational alignment between an upper portion of the barrier member and the structural means, said second hinge assembly comprising (1) third hinge mounting means having means for attachment thereof to the structural means;

(2) fourth hinge mounting means having means for attachment to an upper portion of the barrier member;

(3) a third hinge member mounted for rotation with said fourth hinge mounting means; and (4) a fourth hinge member mounted for rotation with said third hinge member;

said third and fourth hinge members each having relatively smooth engaging surfaces to facilitate rotation therebetween.

2. The hinge of claim 1 wherein said surfaces have corresponding engagement means to retain said first hinge member and said second mounting means in a predetermined position which thereby maintains the barrier member in at least one of at least three positions.

3. The hinge of claim 1 wherein said corresponding engagement means comprising a plurality of substantially identical crenulations, each having oppositely sloped sides.

4. The hinge of claim 1 wherein said barrier member is door means and wherein the structural means comprises a frame member for a refrigerated cabinet.

5. The hinge of claim 1 wherein said hinge mounting means are bracket means removably attached by bolts, screws or adhesive means.

6. The hinge of claim 1 wherein said first, second, third and fourth hinge members are constructed of Delrin®, nylon or metal.

7. The hinge according to claim 1 wherein said first and second hinge mounting means are similarly and correspondingly configured to facilitate mounting said barrier member to said structural means for left hand or right hand rotation.

8. A hinge for rotatably mounting a door to frame means of a refrigerator-freezer combination which comprises:

a first hinge assembly comprising:

first hinge mounting means configured for removable attachment thereof to a structural member of said frame means, said first hinge mounting means defining at least one aperture;

second hinge mounting configured for removable attachment thereof to a lower portion of said door, said second mounting means defining at least one aperture;

a first hinge member removably mounted within an aperture in a predetermined position in one of said apertures defined by said second mounting means for rotation with said second mounting means, said first hinge member comprising a base portion extending upwardly in a substantially vertical direction configured for a corresponding interlocking fit within said aperture and a crown portion extending in a substantially vertical downward direction, said crown portion comprising a plurality of crenulations, each having two oppositely sloped sides;

a second hinge member mounted in a predetermined position in one of said apertures defined by said first mounting means for rotation with said second mounting means, said second hinge member positioned at a predetermined orientation with respect to said first hinge member and comprising a base portion extending in a substantially vertical downward direction and a crown portion extending in a substantially vertical upward direction, said crown portion comprising a plurality of crenulations, each having two oppositely sloped sides, said crenulations of said first and said second hinge members having substantially identical dimensions;

said predetermined orientation of said second hinge member being offset at a predetermined angle with respect to the position of said first hinge member; and means for alignment of said first and said second hinge members in a substantially vertical position;

said first hinge assembly connecting a lower portion of the barrier member to said structural means and bearing substantially all the weight of said barrier member; and a second hinge assembly for providing rotational alignment between an upper portion of the barrier member and the structural means; and wherein said first and second hinge mounting means are similarly and correspondingly configured to facilitate mounting said barrier member to said structural means for left hand or right hand rotation by either rotating the barrier position or by reversing the hinges.

9. The hinge according to claim 8 wherein each hinge member includes three crenulations corresponding to three positions obtainable by said barrier member, said crenulations being rotationally separated from each other by approximately 120 degrees.

10. A hinge for rotatably mounting upper and lower barrier members to structural means which comprises:

a first hinge assembly comprising:

first hinge mounting means having means for attachment thereof to the structural means;

second hinge mounting means having means for attachment thereof to a lower portion of the upper barrier member;

a first hinge member mounted for rotation with said second hinge mounting means;

a second hinge member mounted for rotation with said first hinge mounting means;

said first and second hinge members each having engaging surfaces correspondingly configured to permit staged rotation between said first and second hinge members, thereby facilitating a staged rotation of said upper barrier member in predetermined sequential increments as determined by said respective engaging surfaces; and means for aligning said first and second hinge members, said means extending through said first and second hinge mounting means and terminating at a point below said second hinge mounting means;

said first hinge assembly bearing substantially all the weight of said upper barrier member; and a second hinge assembly for providing rotational alignment between an upper portion of the upper barrier member and the structural means;

a third hinge assembly for providing rotational alignment between an upper portion of said lower barrier member and said structural means comprising:

a third hinge mounting means having means for attachment to an upper portion of the lower barrier member;

a third hinge member mounted upon said third hinge mounting means, said third member defining a hollow bore which at least partially encompasses a lower portion of said alignment means for rotation with a lower portion of said first hinge mounting means; and a fourth hinge assembly for providing rotational alignment between a lower portion of said lower barrier member and the structural means;

whereby said upper and lower barrier members can be vertically spaced apart at a predetermined minimum distance.

11. The hinge of claim 10 wherein the fourth hinge assembly comprises:

fourth hinge mounting means having means for attachment thereof to the structural means;

fifth hinge mounting means having means for attachment thereof to a lower portion of the lower barrier member;

a fourth hinge member mounted for rotation with said fifth hinge mounting means; and a fifth hinge member mounted for rotation with said fourth hinge member;

said fourth and fifth hinge members each having engaging surfaces correspondingly configured to permit staged rotation between said fourth and fifth hinge members, thereby facilitating a staged rotation of said lower barrier member in predetermined sequential increments as determined by said respective engaging surfaces, said fourth hinge assembly bearing substantially all the weight of said barrier member.

12. The hinge according to claim 11 wherein each of said first, second , fourth and fifth hinge members include three crenulations corresponding to three positions of said barrier member, said crenulations being rotationally separated from each other by approximately 120 degrees.

13. The hinge of claim 10 wherein said second hinge assembly comprises:

sixth hinge mounting means having means for attachment thereof to the structural means;

seventh hinge mounting means having means for attachment to the upper portion of the upper barrier member;

a sixth hinge member mounted for rotation with said seventh hinge mounting means; and a seventh hinge member mounted for rotation with said sixth hinge member;

said sixth and seventh hinge members each having relatively smooth engaging surfaces to facilitate rotation therebetween.

14. The hinge according to claim 10 wherein said third hinge member includes a smooth upper surface for engaging a lower surface of the first hinge mounting means and/or a lower surface of the second hinge member to facilitate rotation therebetween.

15. A hinge for rotatably mounting a barrier member to structural means which comprises:

(a) a first hinge assembly comprising 1. first hinge mounting means having means for attachment thereof to the structural means and defining an aperture configured and adapted for insertion of a second hinge member;
2. second hinge mounting means having means for attachment thereof to the barrier member and defining an aperture configured and adapted for insertion of a first hinge member;
3. a first hinge member removably mounted within said aperture in said second hinge mounting means for rotation with said second hinge mounting means; and
4. a second hinge member removably mounted within said aperture in said first hinge mounting means for rotation with said first hinge member;

said first and second hinge members each having engaging surfaces correspondingly configured to permit staged rotation between said first and second hinge members, thereby facilitating a staged rotation of said barrier member in predetermined sequential increments as determined by said respective engaging surfaces, said first hinge assembly connecting a lower portion of the barrier member to said structural means and bearing substantially all the weight of said barrier member; and (b) a second hinge assembly for providing rotational alignment between an upper portion of the barrier member and the structural means;

wherein said surfaces have corresponding engagement means to retain said first hinge member and said second mounting means in a predetermined position which thereby maintains the barrier member in at least one of at least three positions with respect to said structural means, which positions correspond to one opened position, one intermediate position and one closed position.

16. A hinge for rotatably mounting a barrier member to structural means which comprises:

(a) a first hinge assembly comprising 1. first hinge mounting means having means for attachment thereof to the structural means and defining an aperture configured and adapted for insertion of a second hinge member;
2. second hinge mounting means having means for attachment thereof to the barrier member and defining an aperture configured and adapted for insertion of a first hinge member;
3. a first hinge member removably mounted within said aperture in said second hinge mounting means for rotation with said second hinge mounting means;
4. a second hinge member mounted in said aperture in said first hinge mounting means for rotation with said first hinge member; and
5. separate, removable pin means extending through said first and said second hinge member for aligning said first and second hinge members within said first and second hinge mounting means, said first and second hinge members each having engaging surfaces correspondingly configured to permit staged rotation between said first and second hinge members, thereby facilitating a staged rotation of said barrier member in predetermined sequential increments as determined by said respective engaging surfaces, said first hinge assembly connecting a lower portion of the barrier member to said structural means and bearing substantially all the weight of said barrier member; and (b) second hinge assembly for providing rotational alignment between an upper portion of the barrier member and the structural means;

wherein said surfaces have corresponding engagement means to retain said first hinge member and said second mounting means in a predetermined position which thereby maintains the barrier member in at least one of at least three positions with respect to said structural means, which positions correspond to one opened position, one intermediate position and one closed position.

* * * * *